United States Patent [19]

English et al.

[11] Patent Number: 4,549,315

[45] Date of Patent: Oct. 29, 1985

[54] FIREMAN'S BIB OVERALL

[75] Inventors: Raymond English, Lebanon; Michael Towle, Pittsfield, both of N.H.

[73] Assignee: Globe Manufacturing Co., Pittsfield, N.H.

[21] Appl. No.: 619,124

[22] Filed: Jun. 11, 1984

[51] Int. Cl.[4] ..... A41D 13/00; A41D 1/06; A41D 11/00

[52] U.S. Cl. ..... 2/2; 2/79; 2/81; 2/227

[58] Field of Search ..... 2/DIG. 6, 227, 48, 49 R, 2/49 A, 50, 51, 79, 80, 81, 82, 83, 2, 5

[56] References Cited

U.S. PATENT DOCUMENTS

| | | | |
|---|---|---|---|
| Re. 17,047 | 7/1928 | Mahan | 2/230 |
| D. 270,584 | 9/1983 | Ogden | 2/79 |
| 1,208,715 | 12/1916 | Bartrum | 2/79 |
| 1,305,192 | 5/1919 | Butler | 2/79 |
| 1,998,739 | 4/1935 | Sanderson | 2/227 |
| 2,709,667 | 5/1955 | Grubb et al. | 2/81 |
| 2,762,054 | 9/1956 | Smith | 2/227 |
| 3,950,789 | 4/1976 | Konz et al. | 2/DIG. 6 |

*Primary Examiner*—Louis K. Rimrodt
*Assistant Examiner*—Joseph S. Machuga
*Attorney, Agent, or Firm*—Watson, Cole, Grindle & Watson

[57] ABSTRACT

A heat-resistant bib overall for use by a fireman includes a lower trouser portion and an upper bib portion, the lower trouser portion providing right and left outer (side) seams, the bib portion including separate right front and left front and rear bib sections, said bib sections being continuously sewn along their bottom edges to a high waistband formed by a hem along the upper edge of the trouser portion, the rear bib portion extending forwardly to the respective right and left outer (side) seams and the right and left front bib sections extending rearwardly past the respective right and left outer (side) seams, such that the respective front bib sections will overlap the rear bib section along the opposite sides of the bib overall.

8 Claims, 4 Drawing Figures

FIREMAN'S BIB OVERALL

BACKGROUND OF THE INVENTION

1. Field of the Invention

The present invention relates to a heat-resistant bib overall, and more particularly to such a bib overall which can be used as part of a fireman's suit.

2. The Prior Art

Bib overalls made of cotton and similar low-cost materials are common articles of clothing, most often worn by people engaged in domestic or professional work activities. Many different styles and shapes are available. Bib overalls made of heat-resistant materials, although much less commonly seen in commerce, are valuable items of clothing for fireman, such bib overalls comprising an essential part of a fireman's protective suit. These bib overalls conventionally include a lower trouser portion and an upper bib portion, and are maintained in place over the torso of the wearer by use of suitable shoulder straps.

Although the known heat-resistant bib overalls used by fireman generally provide good protection for the wearer from the surrounding heat in the lower leg areas and in the front and rear upper body areas, they are known to provide minimal heat protection along their sides above the waistband, i.e., in the areas below the armpits of the wearer, because the bib portions normally do not cover this area. At the same time, known configurations of bib portions have resulted in poor fittings with the wearer's upper torso, being either too loose when the wearer is upright or too tight when the wearer bends forward.

SUMMARY OF THE INVENTION

An object of the present invention is to provide a heat-resistant bib overall which can be worn by a fireman, i.e., as part of a fireman's suit, which provides enhanced thermal protection along its sides above the waistband and which concurrently provides a comfortable, contoured fit to the upper torso of the wearer.

According to the present invention, a heat-resistant bib overall is provided which comprises a trouser portion and a bib portion, the trouser portion providing a high waistband and opposite outer (side) seams, the bib portion comprising a right front bib section, a left front bib section and a rear bib section, each of the bib sections being continuously sewn along their lower edge to the high waistband, the rear bib section extending forwardly to the outer (lateral) side seams and the right and left front bib sections extending rearwardly of the respective outer (side) seams, such that the front right and left bib sections will overlap the rear bib section along the sides of the bib overall.

Further features and advantages of the invention will become more apparent from a review of the attached drawings, taken in conjunction with the following discussion.

DETAILED DESCRIPTION OF THE PREFERRED EMBODIMENT

Figure 1:
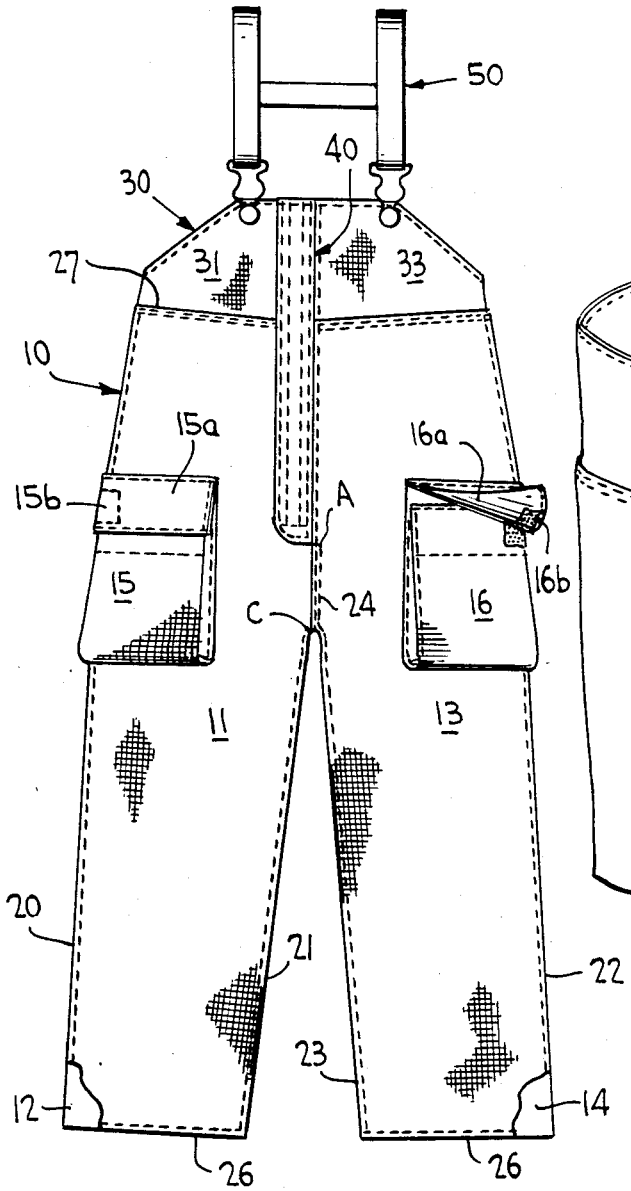
FIG. 1 shows a front elevational view of a bib overall according to the present invention.

A preferred embodiment of bib overall according to the present invention is shown in FIG. 1. It includes a trouser portion 10, a bib portion 30, and a closure strip portion 40. Each of these portions of the bib overall are made from heat-resistant materials, thus enabling the bib overall to be worn by a fireman as part of a fireman's suit. In the following discussion the various parts of the bib overall will be described using the terms right, left, top, bottom, outer (lateral), inner, front and rear, these terms assuming the vantage point of an erect person wearing the bib overall.

The trouser portion 10 includes a right front trouser section 11, a right rear trouser section 12, a left front trouser section 13 and a left rear trouser section 14. The right front and right rear trouser sections 11 and 12 are sewn together along their corresponding outer (lateral) edges to provide a right outer (side) seam 20 which extends upwardly from the corresponding bottom edges of these trouser sections to their corresponding top edges, and they are also sewn together along their corresponding inner edges to provide a right inseam 21 which extends upwardly from their corresponding bottom edges to crotch point C. The left front and left rear trouser sections 13 and 14 are likewise sewn together along their corresponding outer (lateral) edges to provide a left outer (side) seam 22 which extends upwardly from the corresponding bottom edges of these trouser sections to their corresponding top edges, and they are also sewn together along their corresponding inner edges to provide a left inseam 23 which extends upwardly from their corresponding bottom edges to crotch point C. The bottom edges of the trouser sections 11,12 and 13,14 are hemmed to provide cuffs 26.

The right rear and left rear trouser sections 12 and 14 are sewn together along their corresponding inner (rear) edges to provide a rear seam (not specifically shown) which extends downwardly from their corresponding top edges to the crotch point C, and the right front and left front trouser sections 11 and 13 are sewn together along their corresponding inner (front) edges to provide a seam 24 which extends upwardly from the crotch point C to a termination point A (note: the seam 24 is actually an extension of the noted seam provided between the right rear and left rear trouser sections). The right front and left front trouser sections 11 and 13 are not permanently sewn together above the termination point A.

The top edges of all the trouser sections 11–14 are hemmed to provide a high waistband 27 which extends from the inner (front) edge of the right front trouser section 11 around the bib overall to the corresponding inner (front) edge of the left front trouser section 13. The high waistband 27 does not extend between the inner (front) edges of the front trouser sections 11 and 13 because, as noted above, these trouser sections are not sewn together above termination point A.

Figure 2:
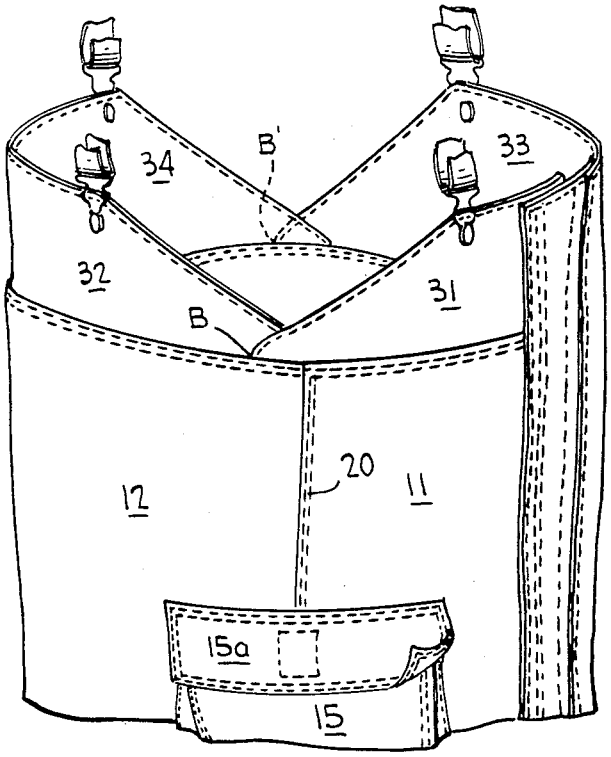
FIG. 2 shows a perspective view of a portion of the right side of the bib overall of FIG. 1.

As shown in FIGS. 1 and 2, the trouser portion 10 also includes expansion pouches 15 and 16 which are respectively sewn to the right and left trouser sections 11,12 and 13,14. More specifically, expansion pouch 15 is sewn in part to the right front trouser section 11 and in part to the right rear trouser section 12, i.e., so as to extend across the seam 20, and the expansion pouch 16 is sewn in part to the left front trouser section 13 and in part to the left rear trouser section 14. The expansion pouches 15 and 16 include cover flaps 15*a* and 16*a* which can be used to close the mouths thereof using cooperating Velcro® connector pads 15*b* and 16*b*, these pads being manufactured by American Velcro Incorporated.

Figure 3:
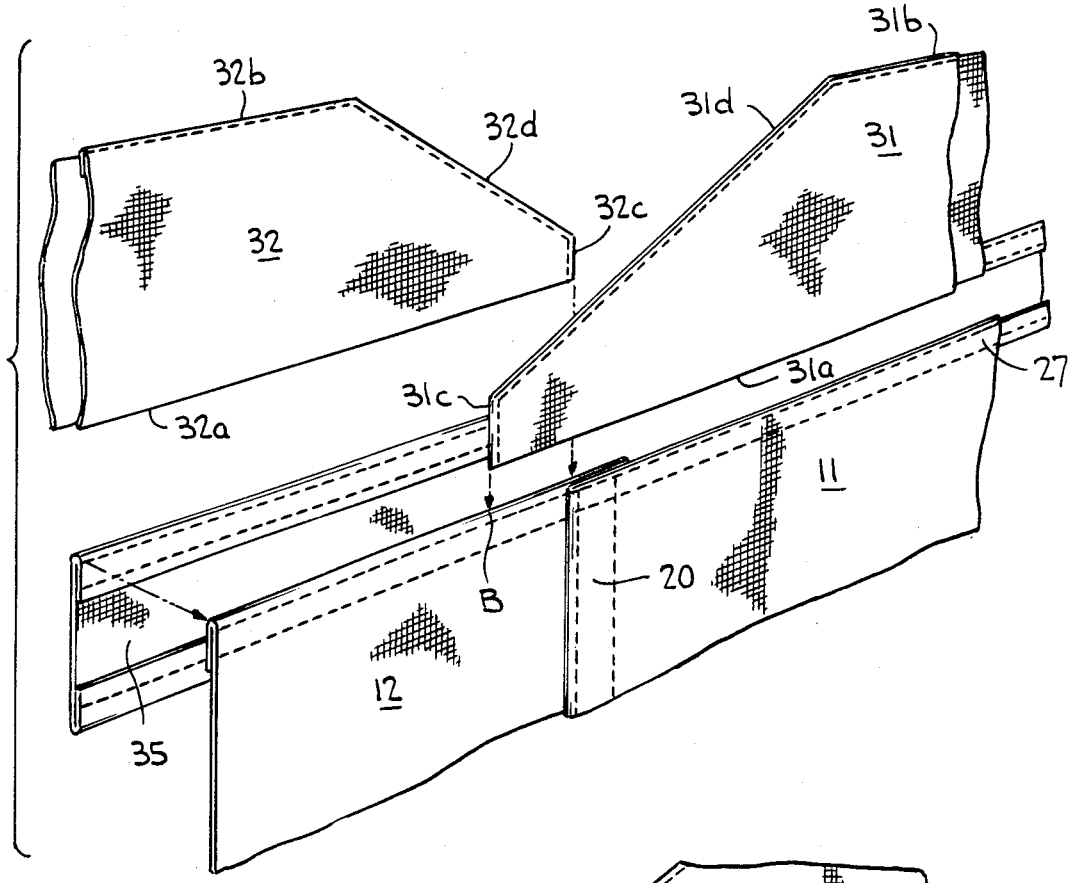
FIG. 3 shows an exploded perspective view of a detail of the right side portion of the bib overall shown in FIG. 1.
Figure 4:
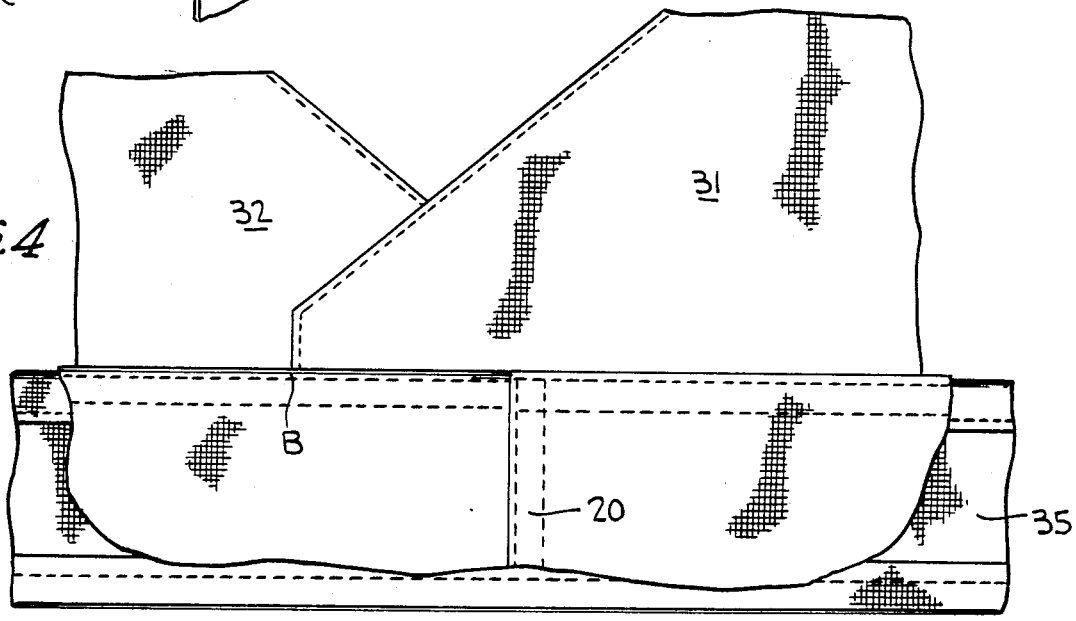
FIG. 4 shows an elevational view of the same detail of the right side of the bib overall as shown in FIG. 3.

The bib portion 30 includes a right front bib section 31, a right rear bib section 32, a left front bib section 33 and a left rear bib section 34. The right front bib section 31 is shaped so as to provide a lower horizontal edge 31*a* (see FIG. 3), an inner (front) vertical edge (not labeled), an upper horizontal edge 31*b*, an outer (lateral) vertical edge 31*c* and a downwardly sloping edge 31*d*, the downwardly sloping edge 31*d* extending between the upper horizontal edge 31*b* and the outer (lateral) vertical edge 31*c*. The outer (lateral) vertical edge 31*c* is much shorter than the inner (front) vertical edge. In a preferred embodiment the inner (front) vertical edge is about 6½ inches long and the outer (lateral) vertical edge is about ½ inch long. As shown in FIGS. 2 and 3, the lower horizontal edge 31*a* of the bib section 31 is continuously sewn along its entire length to the inside of the high waistband 27 such that its inner (front) edge extends above the inner (front) edge of the right front trouser section 11 and its outer (lateral) edge 31*c* extends above the right rear trouser section 12. In this regard, the right front bib section 31 is suitably sized such that it extends to a point B rearwardly of the seam 20.

The left front bib section 33, which is shaped and sized similarly to the right front bib section 31, has its lower horizontal edge sewn to the inside of the high waistband 27 such that its inner (front) vertical edge extends above the inner (front) edge of the left front trouser section 13 and its outer (lateral) vertical edge extends rearwardly of the seam 27 to a point B'. The point B' is located behind the seam 22, a distance equal to the distance point B is located behind the seam 20, a preferred distance being between about 2 and 2½ inches from the center of the respective seams 20,22. All the exposed edges of the front bib sections are hemmed for added strength.

The right rear bib section 32 is shaped similarly to the front bib sections 31 and 33, i.e., so as to include a lower horizontal edge 32*a*, an inner (rear) vertical edge (not specifically depicted), an upper horizontal edge 32*b*, an outer (lateral) vertical edge 32*c* and a downwardly sloping edge 32*d*. The lower horizontal edge 32*a* of this bib section is continuously sewn along its entire length to the inside of the high waistband 27 along the top of the right rear trouser section 12. It is sized such that its inner (rear) edge extends above the inner (rear) edge of the right rear trouser section 12 and its outer (lateral) edge 32*c* extends above the outer (lateral) edge of the right rear trouser section 12 (and thus above the seam 20). The right front and right rear bib sections 31 and 32 will overlap each other from the seam 20 rearwardly to the point B.

The left rear bib section 34, which is shaped and sized similarly to the right rear bib section 32, has its lower horizontal edge sewn to the inside of the high waistband 27 along the rop of the left rear trouser section 14 and is sized such that its inner (rear) edge extends above the inner (rear) edge of the left rear trouser section 14 and its outer (lateral) edge extends above the outer (lateral) edge of the left rear trouser section 14 (and thus above the seam 22). Actually, the inner (rear) edges of the two rear bib sections 32 and 34 are sewn together. The left front and rear bib sections 33 and 34 overlap each other from the seam 22 rearwardly to the point B'. All the exposed edges of each rear bib section 32 and 34 are hemmed for added strength.

As can be seen in FIG. 3, a protector strip 35 is sewn into the inside of the bib overall so as to cover the lower horizontal edges of the various bib sections and the corresponding hem forming the high waistband 27. Furthermore, as can be seen in FIG. 2, each of the bib sections 31–34 includes a metal button fastener to which the loops of an H-shaped shoulder strap 50, used to support the inventive bib overall on a user, can be snap fitted.

The closure strip portion 40, which is sufficiently elongated to extend from the termination point A to the top horizontal edges of the front bib sections 31 and 33, is sewn along one of its elongated side edges to the inner (front) edges of the left front trouser section 13 and the left front bib section 33, such that its opposite side edge overlaps the right front trouser section 11 and the right front bib section 31. The surface of the closure strip portion facing the right front trouser and bib sections includes a Velcro® strip which is cooperable with a Velcro® strip which extends upwardly along the front of the right front trouser section 11 and the right front bib section 31 so as to be detachably interconnectable, thus providing a detachable closure means for the front of the inventive bib overall.

As noted previously, the elements of the bib overall are constructed of heat-resistant materials so as to enable the bib overall to be used as part of a fireman's suit. In a preferred embodiment, the trouser sections are composed of an outer layer of 100% Nomex Brand Aramid III fabric, made by E. I. DuPont deNemours & Co. of Wilmington, Del., and a liner composed of an outer vapor barrier layer of a 100% DuPont Neoprene-coated cotton/polyester fabric and a thermal inner layer of Nomex Brand batting. The bib sections are composed of an outer layer of 100% Nomex Brand Aramid III fabric and an inner layer of a vapor barrier as above and the option of a thermal liner.

In use, the person desiring to wear the inventive bib overall can put it on the usual way, adjusting the shoulder strap 50 so that it fits properly, and thereafter closing the front of the bib overall via the closure strip portion 40. Because the front bib sections 31 and 33 overlap the rear bib sections 32 and 34 along the sides of the bib overall, not only will the bib sections provide an excellent contour to the person's upper torso and concurrently provide size proportion flexibility, but they will prevent any undesirable gapping of the bib sections, thus reducing the risk of heat penetration therepast to the sides of the user when he (or she) is bending over.

Various modifications to the bib overall as described above can be made and still fall within the scope of the appended claims.

We claim:

1. A heat-resistant bib overall which can be used as part of a fireman's suit, said bib overall comprising a trouser portion and a bib portion, said trouser portion providing a high waistband and right and left outer (side) seams, said bib portion comprising a right front bib section, a left front bib section and a rear bib section, each of said bib sections having a lower horizontal edge which is continuously sewn along its length to said high waistband, said rear bib section extending forwardly to said respective right and left outer (side) seams and said right and left front bib sections extending rearwardly of said respective right and left outer (side) seams, such that said front right and front left bib sections will overlap said rear bib section along the respective right and left sides of said bib overall.

2. A heat-resistant bib overall as defined in claim 1 wherein said right front and left front bib sections extend rearwardly of said respective right and left outer (side) seams a distance of between about 2 and $2\frac{1}{2}$ inches.

3. A heat-resistant bib overall as defined in claim 1 wherein the lower horizontal edge of each of said right front and left front bib sections is continuously sewn along its entire length to the inside of said high waistband, and wherein each of said right front and left front bib sections includes an inner (front) vertical edge, an upper horizontal edge, an outer (lateral) vertical edge, and a downwardly sloping edge which extends between the upper horizontal edge and the outer (lateral) vertical edge.

4. A heat-resistant bib overall as defined in claim 3 wherein said rear bib section comprises a right rear bib section and a left rear bib section, and wherein said right and left rear bib sections are sewn together.

5. A heat-resistant bib overall as defined in claim 3 wherein said trouser portion includes a right front trouser section, a right rear trouser section, a left front trouser section and a left rear trouser section, wherein said right front and right rear trouser sections are sewn together along their outer (lateral) edges to form said right outer (side) seam and along their inner edges to form a right inseam, wherein said left front and left rear trouser sections are sewn together along their outer (lateral) edges to form said left outer (side) seam and along their inner edges to form a left inseam, wherein said right and left rear trouser sections are sewn together along their inner (rear) edges to form a rear seam downwardly to a crotch point C and wherein said right front and left front trouser sections are sewn together along their inner (front) edges to form a front seam which extends upwardly from said crotch point C to a termination point A.

6. A heat-resistant bib overall as defined in claim 5 wherein said trouser sections have upper edges which are hemmed so as to form said high waistband, said high waistband extending continuously across the upper edge of the right front trouser section starting at its inner (front) vertical edge, across the entire upper edges of the right and left rear trouser sections, and across the upper edge of the left front trouser section to its inner (front) vertical edge, and wherein said termination point A is located between crotch point C and said waistband.

7. A heat-resistant bib overall as defined in claim 6 wherein the inner (front) vertical edge of said right front bib section extends vertically above the inner (front) edge of said right front trouser section, wherein the inner (front) vertical edge of said left front bib section extends vertically above the inner (front) edge of said left front trouser section, and wherein said bib overall includes an elongated closure strip portion which extends from said termination point A to the hemmed upper edges of said right and left front trouser sections, one elongated side edge of said closure strip portion being sewn along the inner (front) edges of the left front trouser section and the left front bib section, such that its opposite side edge overlaps the right front trouser section, and wherein the right front bib portion facing the right front trouser and bib sections includes means to detachably connect it along its length to said right front trouser and bib sections.

8. A heat-resistant bib overall as defined in claim 7 wherein said means to detachably connect said closure strip portion to said right front trouser section and said right front bib section comprises cooperable Velcro® strips.

* * * * *